US006860716B2

(12) United States Patent
Czachor et al.

(10) Patent No.: US 6,860,716 B2
(45) Date of Patent: Mar. 1, 2005

(54) TURBOMACHINE FRAME STRUCTURE

(75) Inventors: Robert P. Czachor, Wyoming, OH (US); Thomas L. MacLean, Mason, OH (US); Robert E. Jones, Fairfield, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/447,546

(22) Filed: May 29, 2003

(65) Prior Publication Data

US 2004/0240987 A1 Dec. 2, 2004

(51) Int. Cl.[7] ..... F01D 25/16
(52) U.S. Cl. ..... 415/142
(58) Field of Search ..... 415/134, 142, 415/209.2, 209.3, 209.4; 60/39.31, 39.32

(56) References Cited

U.S. PATENT DOCUMENTS 5,180,282 A 1/1993 Lenhart et al. ..... 415/209.2
5,272,869 A 12/1993 Dawson et al. ..... 60/39.31
5,292,227 A 3/1994 Czachor et al. ..... 415/209.3
5,438,756 A 8/1995 Halchak et al. ..... 29/889.2
5,483,792 A * 1/1996 Czachor et al. ..... 60/796
6,358,001 B1 * 3/2002 Bosel et al. ..... 415/142
6,439,841 B1 8/2002 Bosel ..... 415/142
6,672,833 B2 * 1/2004 MacLean et al. ..... 415/196

* cited by examiner

*Primary Examiner*—Ninh H. Nguyen
(74) *Attorney, Agent, or Firm*—William Scott Andes; Alfred J. Mangels

(57) ABSTRACT

A turbomachine frame member including an annular inner hub and a concentric annular outer casing that is spaced radially outwardly from the inner hub to define an annular flow passageway. A plurality of substantially radially-extending, circumferentially-spaced struts interconnect the inner hub and outer casing. The struts are connected to the outer casing by respective pairs of connecting bolts that pass through the outer casing and into the struts to engage barrel nuts.

13 Claims, 5 Drawing Sheets

TURBOMACHINE FRAME STRUCTURE

BACKGROUND OF THE INVENTION

1. Field of the Invention

The present invention relates to a turbomachine frame member for rotatably supporting a turbomachine shaft. More particularly, the present invention relates to a turbomachine frame member that includes an inner annular hub, an outer casing, and a plurality of struts that extend between the hub and the casing, wherein the struts are bolted to the outer casing to provide a lighter, yet sufficiently rigid frame structure.

2. Description of the Related Art

Turbomachines, such as gas turbine engines having rotatable shafts that carry compressors and turbines, or fans and turbines, have their shafts supported in bearings that are housed in support frames. The support frames include inner annular hubs in which the bearings are positioned and outer annular casings that define the outer surface of the engine. The hubs and casings are concentric and are spaced from each other in a radial direction to define an annular flow passageway.

Between the inner hub and the outer casing are a plurality of substantially radially-extending, circumferentially-spaced members that interconnect the hub and the casing. When securely connected together, the components provide a rigid supporting frame for rotatably supporting a drive shaft and also for defining the annular flow passageway. The radial members have exterior surfaces that are generally airfoil-shaped in cross section, with the chords of the airfoil shapes extending in a generally axial direction of the support frame to minimize flow interference.

When utilized in relatively cool sections of a gas turbine engine, such as in the compressor section, the support frames can be cast as an integral structure, or they can be fabricated from cast or sheet metal components that are welded or otherwise joined together to provide a rigid frame. However, in hotter sections of a gas turbine engine, such as downstream of the combustor, in which the frames support a turbine drive shaft, cooling air is generally provided to the interior of the radial members to minimize thermal expansion. The radial members in turbine section frames are often defined by elongated structural struts that are bolted to one or both of the inner hub and the outer casing, and that have through-passageways to allow the flow of cooling air around or through the struts. When such structural struts are utilized, airfoil-shaped outer enclosures or fairings can be provided around the structural struts for aerodynamic efficiency.

When structural struts are bolted either to the outer casing or to the inner hub, or to both in some turbine frame structures, the strut ends can be bolted to a clevis arrangement. The clevis arrangement can be secured to the outer casing or to the inner hub by bolts or by welding. In such bolted-frame structures it is not unusual to bolt a clevis to the inner hub or to the outer casing with four connecting bolts, and the strut end can be bolted to the clevis with two additional connecting bolts for rigidity of the strut-to-clevis connection. Other structural arrangements, in which the strut includes an end cap that is bolted to the strut end and in which the end cap is, in turn, bolted to the inner hub or to the outer casing, can involve the use of as many as eight connecting bolts. The use of a large number of connecting bolts to assemble the components of a turbomachine frame member increases frame assembly and disassembly time, and it also adds considerable weight to the overall frame structure. There is thus a need for a turbomachine support frame structure that provides the necessary strength and rigidity in the operating environment to which the frame is subjected, while minimizing the overall weight of the frame structure.

SUMMARY OF THE INVENTION

Briefly stated, in accordance with one aspect of the present invention, a turbomachine frame member is provided that includes an annular inner hub for receiving and supporting an anti-friction bearing for rotatably supporting a shaft. An annular outer casing of conical form surrounds and is spaced radially outwardly from the inner hub to define an annular flow passageway therebetween, wherein the outer casing is of conical form. A plurality of substantially radially-extending, circumferentially-spaced struts are positioned between and interconnecting the inner hub and the outer casing to provide a substantially rigid turbomachine frame. The struts have an outer end surface and are connected with the outer casing by a plurality of connecting bolts that extend inwardly through the outer casing and into bolt-receiving openings formed in the struts. Barrel nuts are carried within the strut for cooperative engagement with the respective connecting bolts to enable a tight interconnection to be made between the radially outer end of the strut and the inner surface of the outer casing.

BRIEF DESCRIPTION OF THE DRAWINGS

The structure, operation, and advantages of the present invention will become further apparent upon consideration of the following description, taken in conjunction with the accompanying drawings in which.

DESCRIPTION OF THE INVENTION

Figure 1:
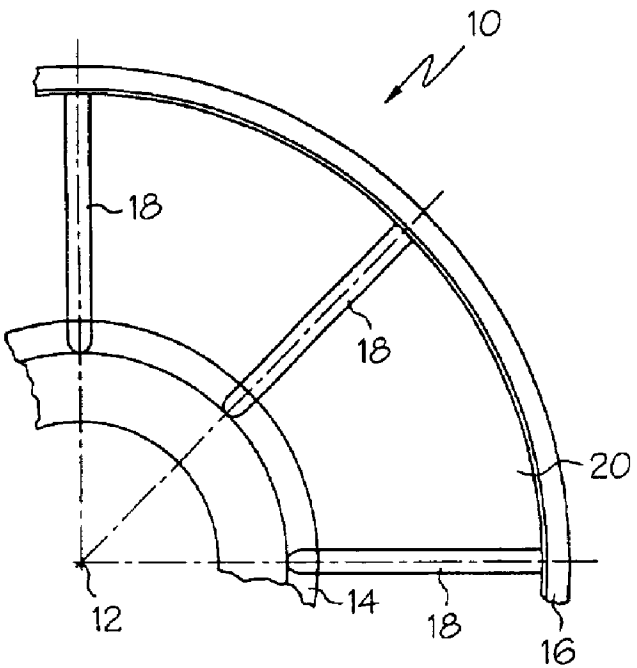
FIG. 1 (PRIOR ART)
FIG. 1 is an elevational view of a quadrant of a typical turbomachine frame structure.

Referring to the drawings, and particularly to FIG. 1 thereof, there is shown in general, overall form a quadrant of a typical turbomachine frame member 10. The structure is an annular one having a central axis 12 and an inner annular hub 14 that houses an anti-friction bearing (not shown), which can be a ball or roller bearing, to rotatably support a drive shaft (not shown) that extends between a compressor and an axial-flow turbine. Positioned radially outwardly of inner hub 14 is an annular outer casing 16 that is concentric with and has a larger diameter than that of inner hub 14. A plurality of substantially radially-extending, circumferentially-spaced struts 18 extend between and interconnect inner hub 14 with outer casing 18 to define frame member 10. Struts 18 generally have a streamlined, airfoiltype shape in cross section, and a chord that extends substantially in the direction of the engine longitudinal axis, to minimize interference to the free flow of gases through an annular flow passageway 20 defined between inner hub 14 and outer casing 16. Depending upon the number of bearings for supporting the drive shaft, an engine can have three or more frame members spaced from each other along the engine longitudinal axis.

As used herein, the term "axial" refers to a direction that is parallel, or substantially parallel, to the longitudinal axis of the engine and to the central axis of the frame member. Similarly, the term "radial" refers to a direction that is substantially radial relative to the engine longitudinal axis, and the term "tangential" refers to a direction that is substantially transversely oriented relative to the engine longitudinal axis.

Figure 2:
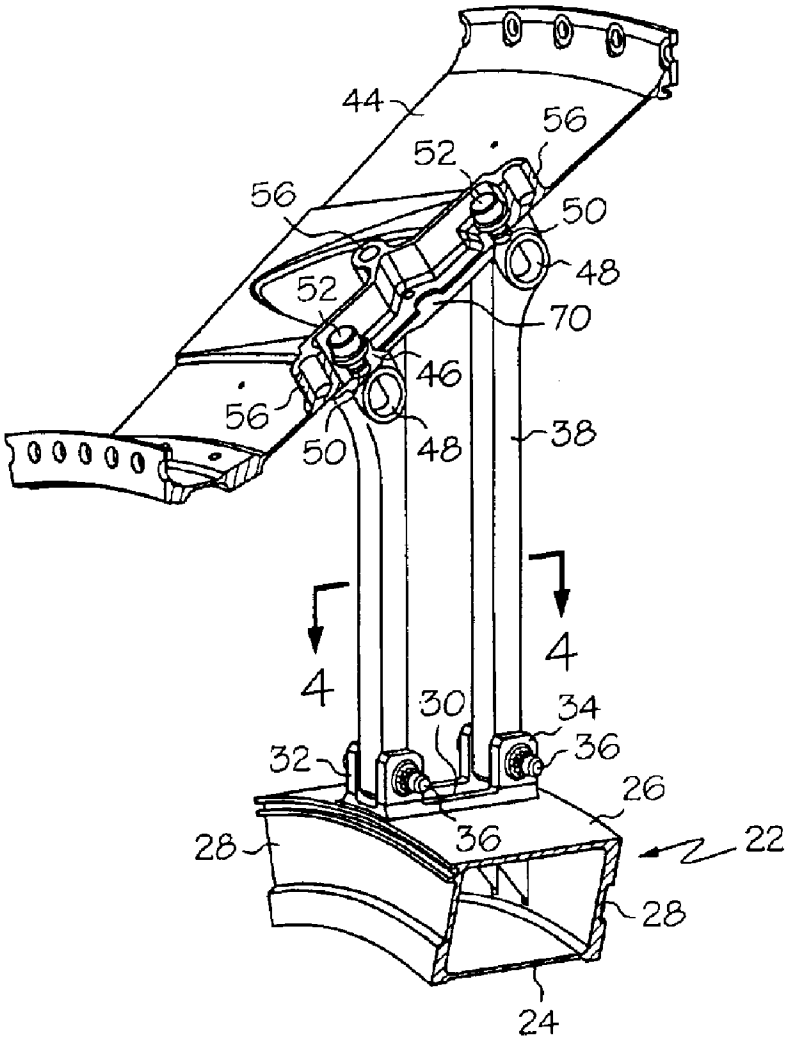
FIG. 2 is a fragmentary perspective view, looking downstream in the direction of flow, of an embodiment of a turbomachine frame showing a strut bolted to a casing and to a hub.
Figure 3:
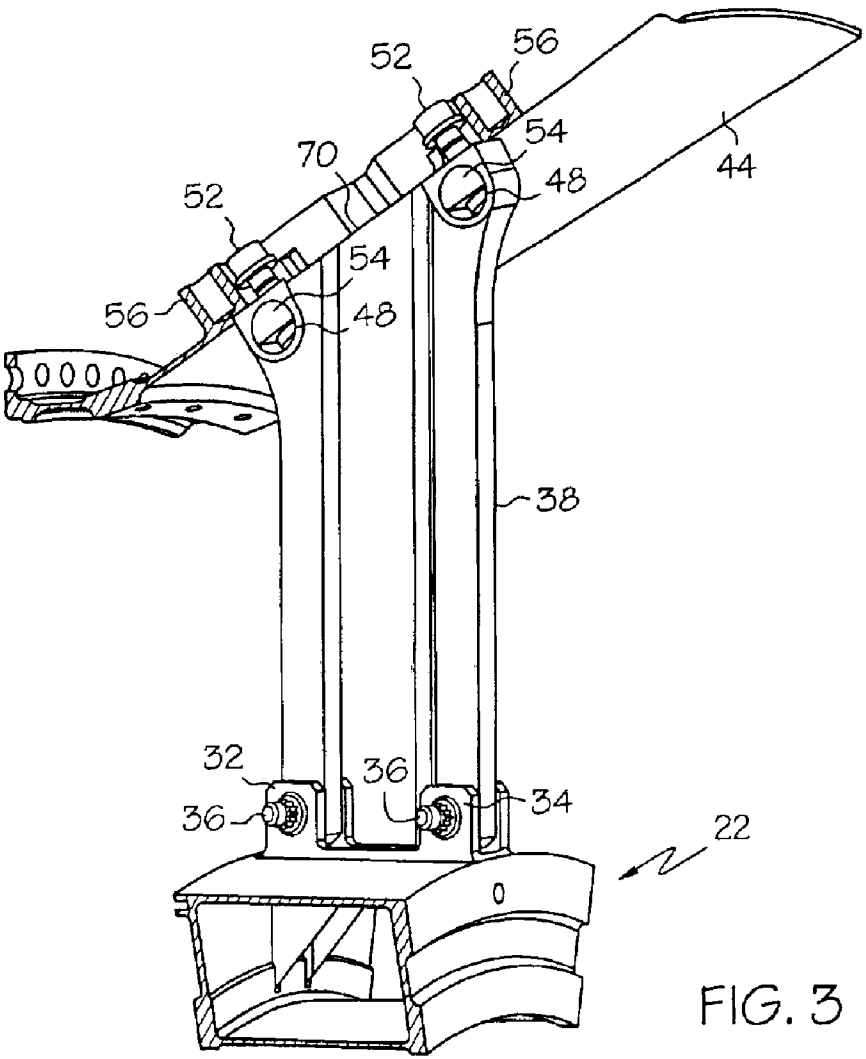
FIG. 3 is a fragmentary perspective view, looking in an upstream direction, of the turbomachine frame embodiment shown in FIG. 2.

An embodiment of an improved turbomachine frame structure that minimizes the number of connecting bolts needed to interconnect the several elements of the structure is shown in FIGS. 2 and 3. An annular inner hub 22 includes an axially-extending inner ring 24, an axially-extending concentric outer ring 26 spaced radially outwardly from inner ring 24, and a pair of axially-spaced, radially-extending side walls 28 to form a closed, hollow ring. A connecting member 30 that includes a pair of axially-spaced, radially-extending devises 32, 34 is carried on the outermost surface of outer ring 26. Connecting member 30 can be integrally formed with the outermost axially-extending surface of outer ring 26, such as by casting, or it can be a separate element that is welded to the outermost axially-extending surface of outer ring 26. Alternatively, connecting member 30 can be a separate element that is bolted to the outermost surface of outer ring 26. Clevises 32, 34 each include a pair of aligned throughbores that extend in a tangential direction, relative to the frame central axis, to receive respective connecting bolts 36 for connecting a structural support strut 38 to inner hub 22. Connecting bolts 36 can advantageously be expansion bolts, to positively align the radially innermost connecting bolt throughbores in strut 38 with the corresponding throughbores provided in devises 32 and 34.

Figure 4:
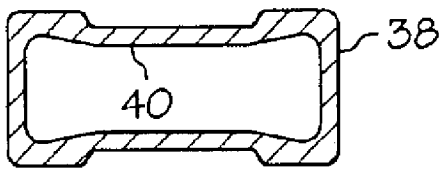
FIG. 4 is a fragmentary cross-sectional view of an axial section of the turbomachine frame embodiment shown in FIG. 2.

Strut 38, which is shown in cross section in FIG. 4, is an elongated, hollow, tubular member that can have a substantially rectangular cross section, and that includes an inner, axial passageway 40 that extends completely along and through strut 38 in the longitudinal direction of the strut. Passageway 40 allows cooling air to pass through strut 38, and it also allows tubular conduits to pass therethrough, such as conduit 42 shown in FIG. 6, which can be for lubricating oil for the bearing (not shown) that is associated with inner hub 22. Strut 38 extends radially outwardly from connecting member 30, which is connected with inner hub 22, to contact the inner surface of and to interconnect with outer casing 44. As shown, outer casing 44 is an annular member that is inclined in an axial direction, relative to the central axis of inner hub 22. Additionally, the outermost end surface 46 of strut 38 is similarly inclined, in an axial direction of the frame, to conform with the inclination of the inner surface of outer casing 44, to allow direct, zero-clearance contact of strut 38 with the inner surface of the outer casing.

Adjacent the radially outermost end of strut 38 is a pair of axially-spaced, transversely-extending throughbores 48, each of which is spaced inwardly of the radially outermost surface of strut 38. A pair of bores 50 extend inwardly from strut end surface 46 to communicate with respective ones of throughbores 48. The connection of strut 38 to outer casing 44 is effected by connecting bolts 52 that pass through respective bolt openings formed in outer casing 44. Bolts 52 extend through bores 50 and into respective throughbores 48. The bolt openings in the outer casing are aligned with bores 50 at the upper end of strut 38, so that the shanks of connecting bolts 52 extend through the outer casing bolt openings and into throughbores 48.

Figure 7:
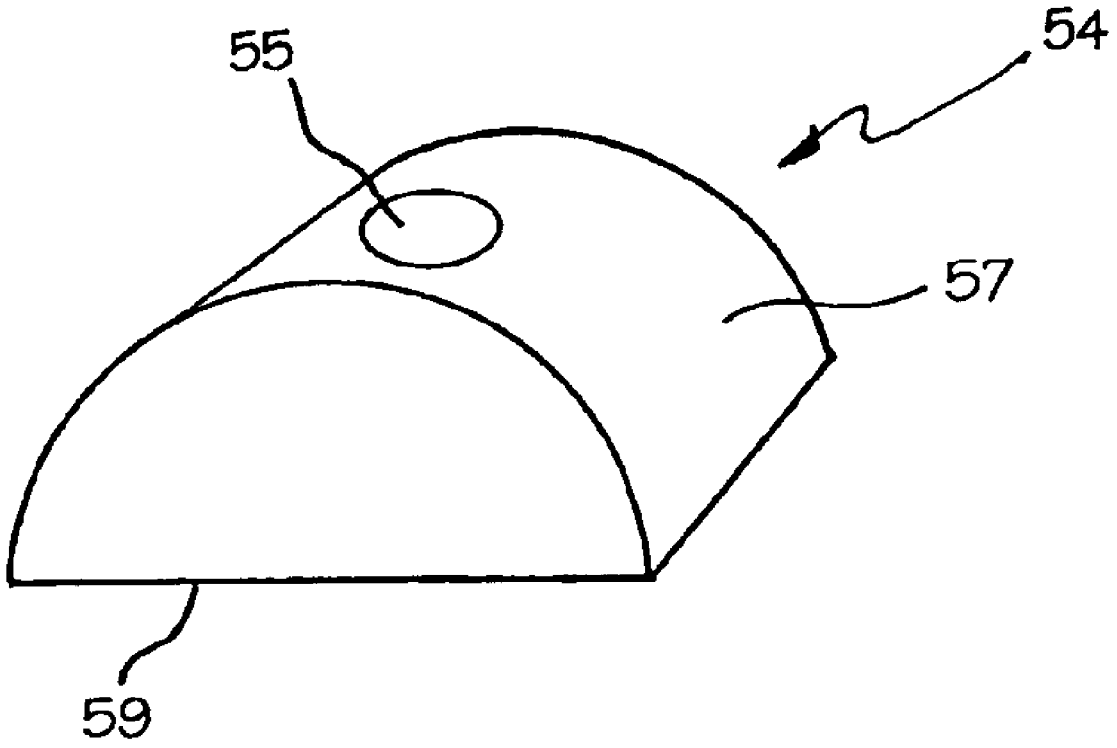
FIG. 7 is a perspective view of a barrel nut.

As best seen in FIGS. 3 and 7, within each throughbore 48 there is positioned a barrel nut 54 that has a surface curvature that substantially corresponds with that of throughbores 48. In that regard, throughbores 48 have a diameter sufficiently large to receive the outer ends of connecting bolts 52. For the purposes of the present application, the term "barrel nut" refers to a nut having the approximate form of a half-round cylinder with a substantially semicircular cross section, as shown in a perspective view in FIG. 7. Barrel nuts 54 include a threaded bore 55 that extends inwardly from the outer, substantially cylindrical surface 57 through the body of the half-round cylinder, to terminate at a flat, substantially diametral inner surface 59.

As shown in FIGS. 2 and 3, outer casing 44 can include on its outwardly-facing surface one or more outwardly-extending bosses 56 having threaded openings to allow the attachment of additional or auxiliary components to the outside of outer casing 44. For example, a cooling air manifold can be attached to outer casing 44 by bolts extending into the threaded openings in bosses 56, to allow cooling air to be introduced into the interior of strut 38.

Figure 5:
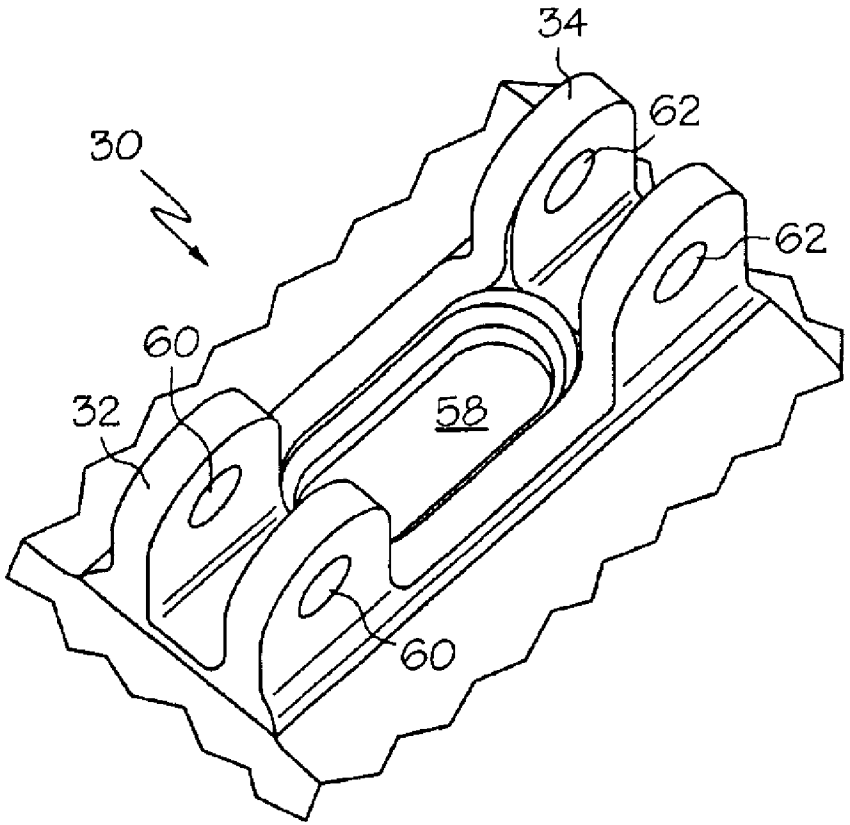
FIG. 5 is a fragmentary top perspective view of the clevis arrangement shown in FIG. 2.

FIG. 5 is an enlarged, fragmentary view of a connecting member 30 having a pair of side-by-side devises 32, 34 for receiving the inner radial end of a strut 38. Member 30 includes pairs of aligned openings 60, 62 through which connecting bolts 36 extend to securely connect strut 38 to connecting member 30. A through-opening 58 is provided in the base of connecting member 30 to allow communication between strut inner passageway 40 and the interior of inner hub 22 to provide a cooling air flow path.

Figure 6:
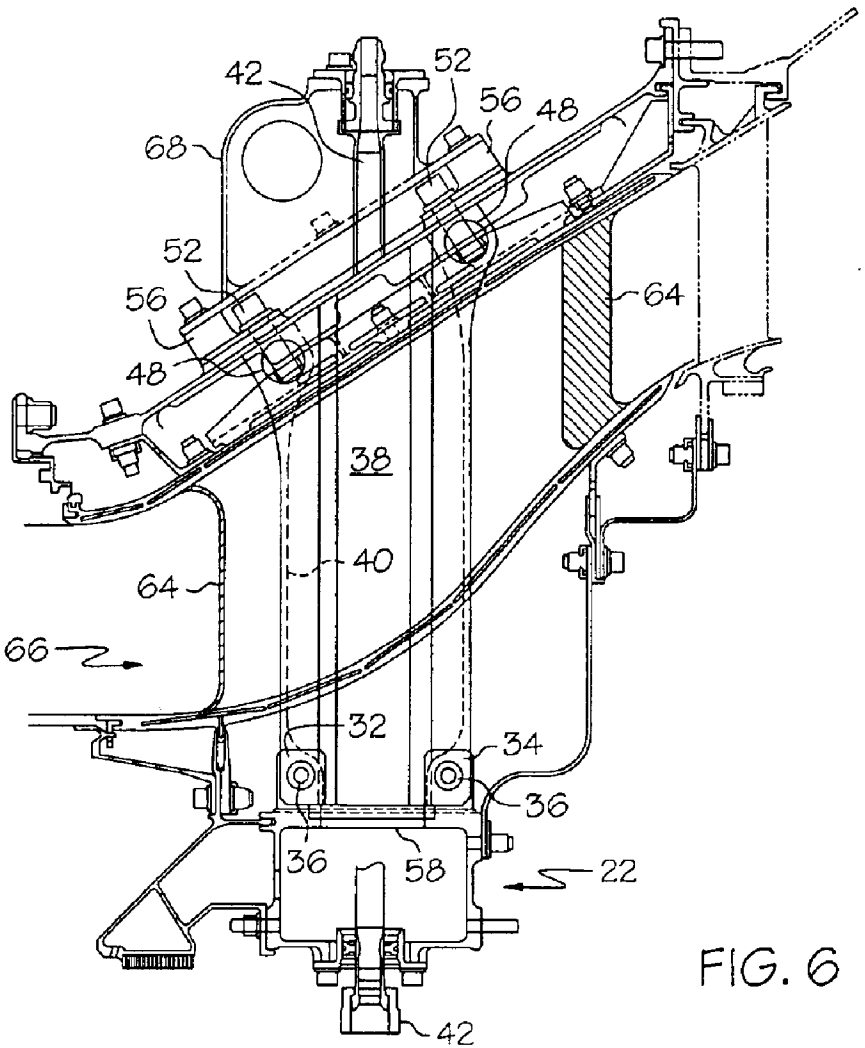
FIG. 6 is a an axial cross-sectional view of the strut structure shown in FIG. 2.

FIG. 6 is a cross-sectional view that shows the frame member illustrated in FIGS. 2 and 3 assembled to a surrounding structure to provide a turbine frame for a gas turbine engine. An aerodynamically-shaped outer housing or fairing 64 is provided that surrounds strut 38 between inner hub 22 and outer casing 44 to define a smooth, gradually curved, aerodynamic outer surface to minimize flow interference and turbulence for hot gases that flow past fairing 64 from an annular upstream passageway 66. Also shown in FIG. 6 is lubricating oil conduit 42 that extends through outer casing 44, through inner passageway 40 of strut 38, and into and through inner hub 22.

Mounted on the outer surface of outer casing 44 is a cooling air manifold 68 that is in communication with a source of cooling air, such as from an upstream compressor stage. As best seen in FIGS. 2 and 3, outer casing 44 includes an opening 70 that is aligned with inner passageway 40 within strut 38. The cooling air can be ducted to manifold 68 to pass into and through strut inner passageway 40, to flow into the annular space defined by inner hub 22 to cool the bearing.

Although only a single strut has been described, it will be apparent to those skilled in the art that several such struts are circumferentially positioned to provide a complete frame structure having the overall structure shown in quarter-section in FIG. 1.

The frame structure as illustrated and described allows the formation of a strong, rigid frame from separate components. It also provides a frame structure having a minimum of connecting bolts, for lighter overall frame weight, as compared with previous designs. Additionally, because the outer casing is inclined relative to the engine longitudinal axis, as is the radially outer surface of the support strut, the bolted connection of the strut to the outer casing can be made to be a zero-tolerance interconnection. In that regard, when the bolts connecting the radially outer surface of the strut with the inner surface of the outer casing are tightened, the bolts draw the end of the strut tightly against the outer casing. If the outer casing was of a cylindrical form, not inclined relative to the engine longitudinal axis, obtaining a tight, zero-tolerance interconnection at the outer casing is more difficult because of manufacturing tolerances in the radial direction, which can result in components that do not precisely mate to provide a zero-tolerance interconnection.

Although particular embodiments of the present invention have been illustrated and described, it would be apparent to those skilled in the art that various changes and modifications can be made without departing from the spirit of the present invention. It is therefore intended to encompass within the appended claims all such changes and modifications that fall within the scope of the invention.

What is claimed is:

1. A turbomachine frame member comprising:

a) an annular inner hub for receiving and supporting an anti-friction bearing for rotatably supporting a shaft;

b) an annular outer casing surrounding and spaced radially outwardly from the inner hub to define an annular flow passageway therebetween, wherein the outer casing is of conical form; and c) a plurality of substantially radially-extending, circumferentially-spaced struts positioned between and interconnecting the inner hub and the outer casing to provide a substantially rigid turbomachine frame, wherein the struts have an inclined radial outer end surface and are connected with the outer casing by a plurality of connecting bolts that extend inwardly through the outer casing and into bolt-receiving openings formed in the struts, wherein each strut includes at least one bolt-receiving opening extending through the strut outer end surface and a nut-receiving opening extending transversely relative to the strut and in communication with the at least one bolt-receiving opening, and a barrel nut carried within at least one nut-receiving opening of the struts for cooperative engagement with a respective connecting bolt to enable a tight interconnection to be made between radially outer ends of the struts and an inner surface of the outer casing.

2. A turbomachine frame member in accordance with claim 1, wherein the struts are hollow and include longitudinally-extending flow passageways therethrough.

3. A turbomachine frame member in accordance with claim 1, wherein the struts are bolted to the inner hub.

4. A turbomachine frame member in accordance with claim 3, wherein the inner hub bolts are expansion bolts.

5. A turbomachine frame member in accordance with claim 1, wherein the struts are connected with the inner hub by a connecting member that is integral with the hub.

6. A turbomachine frame member in accordance with claim 1, wherein the connecting bolts extend substantially perpendicular to an outer surface of the outer casing.

7. A turbomachine frame member in accordance with claim 1, including outer, aerodynamically-shaped fairings surrounding and enclosing the struts.

8. A turbomachine frame member in accordance with claim 1, wherein the barrel nuts have a substantially semicircular cross section.

9. A turbomachine frame member in accordance with claim 1, wherein the barrel nuts have a curved surface that contacts the bolt-receiving opening.

10. A turbomachine frame member in accordance with claim 9, wherein the bolt-receiving opening has a curvature corresponding with that of the barrel nut curved surface.

11. A turbomachine frame member in accordance with claim 1, wherein the nut-receiving opening has a curved inner surface region and the barrel nut has a curved outer surface region, and wherein the barrel nut curved outer region is in contacting relationship with the curved inner surface region of the nut-receiving opening.

12. A turbomachine frame member in accordance with claim 1, wherein the bolt-receiving opening has a longitudinal axis that extends substantially perpendicular to the strut outer end surface.

13. A turbomachine frame member in accordance with claim 12, wherein the nut-receiving opening has a longitudinal axis that extends substantially perpendicular to the longitudinal axis of the at least one bolt-receiving opening.

* * * * *